US009750327B2

(12) United States Patent
Smiley

(10) Patent No.: US 9,750,327 B2
(45) Date of Patent: Sep. 5, 2017

(54) HAIR STYLING DEVICE

(71) Applicant: Nadra Safia Smiley, Chicago, IL (US)

(72) Inventor: Nadra Safia Smiley, Chicago, IL (US)

( * ) Notice: Subject to any disclaimer, the term of this patent is extended or adjusted under 35 U.S.C. 154(b) by 1 day.

(21) Appl. No.: 14/150,641

(22) Filed: Jan. 8, 2014

(65) Prior Publication Data

US 2014/0191634 A1 Jul. 10, 2014

Related U.S. Application Data

(60) Provisional application No. 61/750,434, filed on Jan. 9, 2013.

(51) Int. Cl.

| | |
|---|---|
| ***A45D 44/14*** | (2006.01) |
| ***A47F 7/06*** | (2006.01) |
| ***D01G 7/12*** | (2006.01) |
| ***A45D 44/06*** | (2006.01) |

(52) U.S. Cl.

CPC ..... *A45D 44/14* (2013.01); *A45D 44/06* (2013.01); *A47F 7/065* (2013.01); *D01G 7/12* (2013.01)

(58) Field of Classification Search

CPC ..... A47F 7/065; A45D 44/06; A45D 44/14; D01G 2/12; D01G 15/76; D01G 15/766; D01G 7/12

See application file for complete search history.

(56) References Cited

U.S. PATENT DOCUMENTS 1,526,783 A * 2/1925 Goldberg ..... 19/98
1,571,937 A * 2/1926 Frye ..... 119/632
1,695,765 A * 12/1928 Howes ..... 19/98
1,748,950 A * 3/1930 Goldberg ..... 19/98
1,792,831 A * 2/1931 Gourdeau ..... 19/98
1,818,495 A * 8/1931 Midgley ..... 119/632
1,820,380 A * 8/1931 Dutton ..... 19/98
1,889,369 A * 11/1932 Midgley ..... 19/98

(Continued)

OTHER PUBLICATIONS

Hair Laboratories Inc.; Website showing various hair accessories—available @ www.hairlaboratories.com/hairdrawingmats.aspx.

(Continued)

*Primary Examiner* — Shaun R Hurley

(74) *Attorney, Agent, or Firm* — Vangelis Economou; The John Marshall Law School Patent Clinic

(57) ABSTRACT

A hair stylist device comprises a top and bottom board, each having a plurality of opposed bristles for retaining strands of bulk artificial or commercial hair therebetween for performing hairstyling operations, and including a hinge mechanism for opening and closing the boards around the bulk hair retaining it loosely but securely, while allowing the removal of strands of bulk hair without opening the device providing optimal gripping ability to the bulk hair while permitting removal of hair without unnecessary loss. The board inner surfaces each may have a generally planar pad with plural embedded bristles extending in a direction perpendicular to one surface of the pad. A longitudinal hinge connects the two boards to each other and a lock can secure the opposite longitudinal ends to each other. Compartments disposed at a surface of the boards provide storage for any necessary accessories required for the braiding or weaving process.

10 Claims, 10 Drawing Sheets

(56) References Cited

U.S. PATENT DOCUMENTS

| | | | | | |
|---|---|---|---|---|---|
| 3,658,283 | A * | 4/1972 | Martin | 248/122.1 |
| 3,809,383 | A * | 5/1974 | Ptacek | 269/91 |
| 4,369,690 | A | 1/1983 | Sapkus | |
| 5,014,394 | A * | 5/1991 | Gloor et al. | 19/98 |
| D348,999 | S | 7/1994 | Bonazza | |
| 5,361,468 | A * | 11/1994 | Ho | 28/279 |
| 5,865,190 | A | 2/1999 | Butler | |
| 5,899,211 | A | 5/1999 | Brown | |
| 5,930,862 | A * | 8/1999 | Garrett | 15/200 |
| 6,354,306 | B1 | 3/2002 | Russell | |
| 6,863,075 | B2 | 3/2005 | Wells | |
| 6,913,230 | B2 | 7/2005 | Wells | |
| 6,938,766 | B1 * | 9/2005 | Lee | 206/388 |
| 7,028,853 | B1 * | 4/2006 | Simms | 211/85.3 |
| 7,159,728 | B2 | 1/2007 | Smith | |
| 7,775,377 | B2 | 8/2010 | Abney | |
| 2005/0016557 | A1 | 1/2005 | Fasan | |
| 2006/0289368 | A1 * | 12/2006 | Abney | 211/13.1 |
| 2008/0257370 | A1 | 10/2008 | Perry | |
| 2009/0008347 | A1 * | 1/2009 | Bell | 211/61 |
| 2013/0291339 | A1 * | 11/2013 | Romine | 19/81 |

OTHER PUBLICATIONS

Hibu (UK) Limited; Website showing various hair accessories—available @ http://jasonpaulhairshop.co.uk/drawing-mat.

Banbury Postiche(UK); Website showing various hair accessories—available @ https://www.banburypostiche.co.uk/NEW_27X14cm_Mixing_Hackle_Medium_81.

Banbury Postiche(UK); Website showing various hair accessories—available @ https://www.banburypostiche.co.uk/Cover_for_Hackles_Medium_86.

Banbury Postiche(UK); Website showing various hair accessories—available @ https://www.banburypostiche.co.uk/Drawing_Brushes_(Best)_(150x_350mm_Pair)_87.

Banbury Postiche(UK); Website showing various hair accessories—available @ https://www.banburypostiche.co.uk/Block_Holder_Floor_Stand_51.

* cited by examiner

HAIR STYLING DEVICE

CROSS-REFERENCE TO RELATED APPLICATIONS

This application is a non-provisional application of U.S. Provisional Application No. 61/750,434 filed Jan. 9, 2013, the entire specification of which is incorporated by reference as if fully set forth herein.

STATEMENT REGARDING FEDERALLY SPONSORED RESEARCH OR DEVELOPMENT

None.

BACKGROUND OF THE INVENTION

1. Field of the Invention

The present invention general relates to an device for and method of styling, grooming and enhancing hair and more specifically, it relates to such device and method that permit a hair stylist to prepare hair replacement and augmentation extensions for attachment to a person's coiffure, and to assist the hair stylist in the application process.

2. Background Art

It has become common practice for people to enhance their natural hair by artificial means, such as hair extensions. One method is to braid or weave commercial or artificial hair together with a person's natural hair to give the person's hair a fuller or longer look by attaching hair extensions to a person's existing hair. An extension is a plurality or bundle of individual hairs, each hair usually of a consistent length. Usually each extension is attached to existing hair strands at a point of connection adjacent the client's head, perhaps about one quarter inch away from the scalp. When applied properly, the extensions blend in naturally with the client's own hair, providing additional length and/or fullness to the client's existing hairstyle to produce a pleasing effect.

Known procedures for braiding or weaving artificial hair to a person's natural hair are time consuming and may take anywhere from 2 to 10 hours to complete, depending on facilities available and the extent of the augmentation. Braiding or weaving of commercial or artificial hair is performed by taking a small group of strands, i.e., a tuft, of commercial or artificial hair from a pack of bulk hair which is to be added to the customer's natural hair and using each small group to separately braid, interweave, intersperse, fuse or glue with a desired amount of the customer's natural hair in a small area of the customer's scalp. Between one and six packs or bundles of commercial or artificial hair, taken from packets of bulk hair, are typically used when lengthening or thickening a full head of hair. Thus, it is often desirable to treat the extensions before applying them to a client to save time. For example, the color or shade of the extension, length, and types of hair, either curly or straight, may require alteration prior to application.

During the braiding or weaving process, the entire pack of commercial or artificial bulk hair must be kept clean, organized, controlled and untangled to avoid unnecessary loss or spoilage. Spoilage can result if the hair strands are not secured in place and fall to the floor, after which they become unusable. The working area of a hairstylist does not allow for the placement of commercial or artificial hair where it will remain clean, organized, controlled and untangled for long periods of time necessary to apply the hair strands to the customer's coiffure. Few alternative options are available for holding the pack or bundle of commercial or artificial bulk hair awaiting braiding or weaving. The simplest conventional method is for the hair stylist to lay out the packets of hair on a nearby counter or to drape them over his or her shoulder. The available means heretofore known simply hold commercial or artificial hair temporarily in place essentially without providing a platform that allows the stylist to manipulate, straighten, detangle or otherwise work on the bulk hair before application.

For example, U.S. Pat. No. 7,775,377, issued on Aug. 17, 2010, entitled "Hair Rack" described and illustrates a rack for hair extensions. The device described therein has six rack arms that are attached to a cylindrical drum and each rack arm radiates outwardly from the drum. Each rack arm comprises a plurality of parallel and spaced apart teeth, the teeth generally transverse the main axis of the rack arm. Each of these arms retains and prevents the hair extension from falling to the ground or tangling. A related invention is described in U.S. Pat. Nos. 6,863,075 and 6,913,230, both entitled "Hair Braiding and Weaving Accessory" and issued in 2005. These describe and illustrate a base, an adjustable pole and a disc. The disc holds one to seven packs or bundles of commercial or artificial hair and keeps the hair clean, organized, controlled and untangled. There are notches around the edge of the disc that allow the hairstylist to have pre-divided groups of strands which allows the same amount of artificial hair to be used in each section of the persons natural hair.

U.S. Published Patent Application No. 2005/0016557 A1, published on Jan. 27, 2005 and entitled "Hair Brush," discloses and describes and illustrates two brush heads pivotally connected by a pin extending through the pivotable ends of the hair brush. Each of the brush heads include a plurality of bristles that extend outwardly from surface of each of the brush heads toward the other brush head, and when closed, the bristles interlock to permit brushing of hair therebetween.

U.S. Pat. No. 6,681,775 B2 issued on Jan. 27, 2004 and entitled "Brush Provided with Retractable Bristles to Facilitate Removal of Tangled Hair Strands Therefrom" describes and illustrates a brush with a bristle-receiving chamber.

The devices and systems that are disclosed by these patents and applications, while able to accomplish goals and solve problems that are identified therein, each have very drawbacks. The hairstylist must manually pre-divide the hair before installation for some of the devices and many devices do not provide the ability to untangle matted or bulk hair before application. Over time, continued loose storage causes the commercial or artificial hair to become mixed up, tangled, uncontrolled and if it falls to the ground, unsanitary. When this happens, the hair becomes unusable and must be discarded. Thus, either the consumer or hair stylist will have to absorb the cost of hair loss.

Other known uses are described on the Internet, for example, on a site called http://www.aliexpress.com, which as of the filing date hereof, advertises products called "Hair Extension Drawing Mats, Hair Holder, Hair Extension Tools." These are available at (http://www.aliexpress.com/item/Hair-Extension-Drawing-Mats-Hair-Holaer-Hair-Extension-Tools/556919134.html). The products include plural mats, each having outwardly extending staple ends that interlock with each other, for the purposes of disentangling hair or holding hair strands in place for storage during the application process. The mats are made from a rubberized material and are attachable to boards.

All of the structures disclosed above suffer from one or more disadvantages, for example, not having an all in one device that has all the significant features combined that is also portable and modular at the same time. The present invention is intended to provide a new and improved hair styling device solving many of the above noted problems.

SUMMARY OF THE INVENTION

The present invention is directed to a device for solving the above-identified problems and for meeting the needs of the industry by providing desirable features. The device preferably allows the stylist to organize the hair extensions in a manner which expedites the application process, maintaining each extension untangled and detangled from the others. The device allows the stylist to locate each extension easily during the application process and to withdraw it from the device as needed. Moreover, the device holds the extensions in place during any desired pre-application treatments, and even allows detangling of the extensions if it becomes tangled at any point during the process. The disclosed device contains all the materials that are necessary for the stylist for hair braiding and weaving process at one place. Ideally, the device providing all these features is portable and otherwise unrestricted in use and may be adjustable in height to accommodate the working situation and convenience of the hairstylist.

In order to provide the benefits of the invention, one embodiment of the inventive hair styling device comprises a device for holding and organizing strands of commercial or artificial hair as it is used in braiding, weaving and similar hair applications generally comprising a bottom board having an inner and outer surface, the outer bottom board surface being configured, shaped and dimensioned for providing a fixed connection to an external mount, the bottom board inner surface further including a first plurality of bristles extending in a perpendicular direction away from the inner surface of the bottom board, a top board, engageable with said bottom board by a hinge mechanism, the top board having an inner and outer surface and further including a second plurality of bristles extending in a perpendicular direction away from the inner surface of the top board, a hinge mechanism arranged at a first longitudinal end of each of the top and bottom boards, the hinge mechanism enabling the top board to be rotated around a hinge axis to remove the board inner surfaces from a closed position in which the inner surfaces are opposed to each other to an open position in which the bristles are capable of being loaded with strands of commercial or artificial hair, to a closed position in which the first plurality of bristles are in an interleaved relationship with the second plurality of bristles thereby providing small gaps between the bristles; and a locking mechanism for locking a second end of the top and bottom boards, longitudinally opposite the first longitudinal ends, to each other whereby the top and bottom boards are locked into a closed position, whereby the open position of the boards enables the placement of strands of commercial or artificial hair in the small gaps between the bristles of the bottom board and the closed position of the boards over the strands of commercial or artificial hair retains them in place for hairstyling operations.

The present invention further allows for the holding of bulk artificial hair while allowing the stylist freedom of movement and hands free retention of the bulk artificial or commercial hair, thereby ensuring proper weaving and braiding. Holding the pack of bundle is both tiring and stressful since the hair must be held in a manner which prevents the hair from falling to or touching the ground. Furthermore, the interlocking bristles allow for the hair to be untangled as it is pulled out of the invention. This allows for effective and efficient hair styling conserving time and avoiding unnecessary effort and stress.

In another embodiment of the device, it preferably comprises a base, a pole and a removable hair retention assembly. The base ideally has wheels that allow the device to be movable and portable but when it is erect, it is sturdy enough that it is not easily tipped over. The height of the pole is adjustable and is attached to the base in a conventional manner. The removable hair retention assembly comprises a top and bottom board, each containing a flat pad that has a plurality of embedded bristles extending in a uniform direction perpendicularly to one surface of the pad. The removable hair retention assembly has a protruding mounting member that is attachable to a plurality of different types of mounts, including to the pole with the base or to a countertop, desk, table, etc.

In order to provide optimal gripping ability while permitting the stylist to remove the hair through the device without unnecessary loss, each of the boards (top and bottom) is provided with a plurality of bristles that are provided in a grid configuration with each bristle spaced apart from the other bristles, ideally by a predetermined distance between the bristles. During use, the hairstylist places multiple packs or bundles of commercial or artificial hair on the bottom board and close the top board, in a way that bristles on each side are staggered one over the other creating the groove. Then, the two boards are secured in place by a fastening device. As the hairstylist requires certain strands of commercial or artificial hair to braid or weave with the person's natural hair, the hairstylist can easily remove the desired number of strands between the two boards simply by pulling them out from between the boards. In addition, compartments optionally attached to the device may be used to provide storage for any necessary accessories required for the braiding or weaving process. The hair stylist device comprises everything that a hairstylist would need in one device.

BRIEF DESCRIPTION OF THE DRAWING FIGURES

The present invention will now be discussed in further detail below with reference to the accompanying figures in which.

DETAILED DESCRIPTION OF THE PREFERRED EMBODIMENTS

Figure 1:
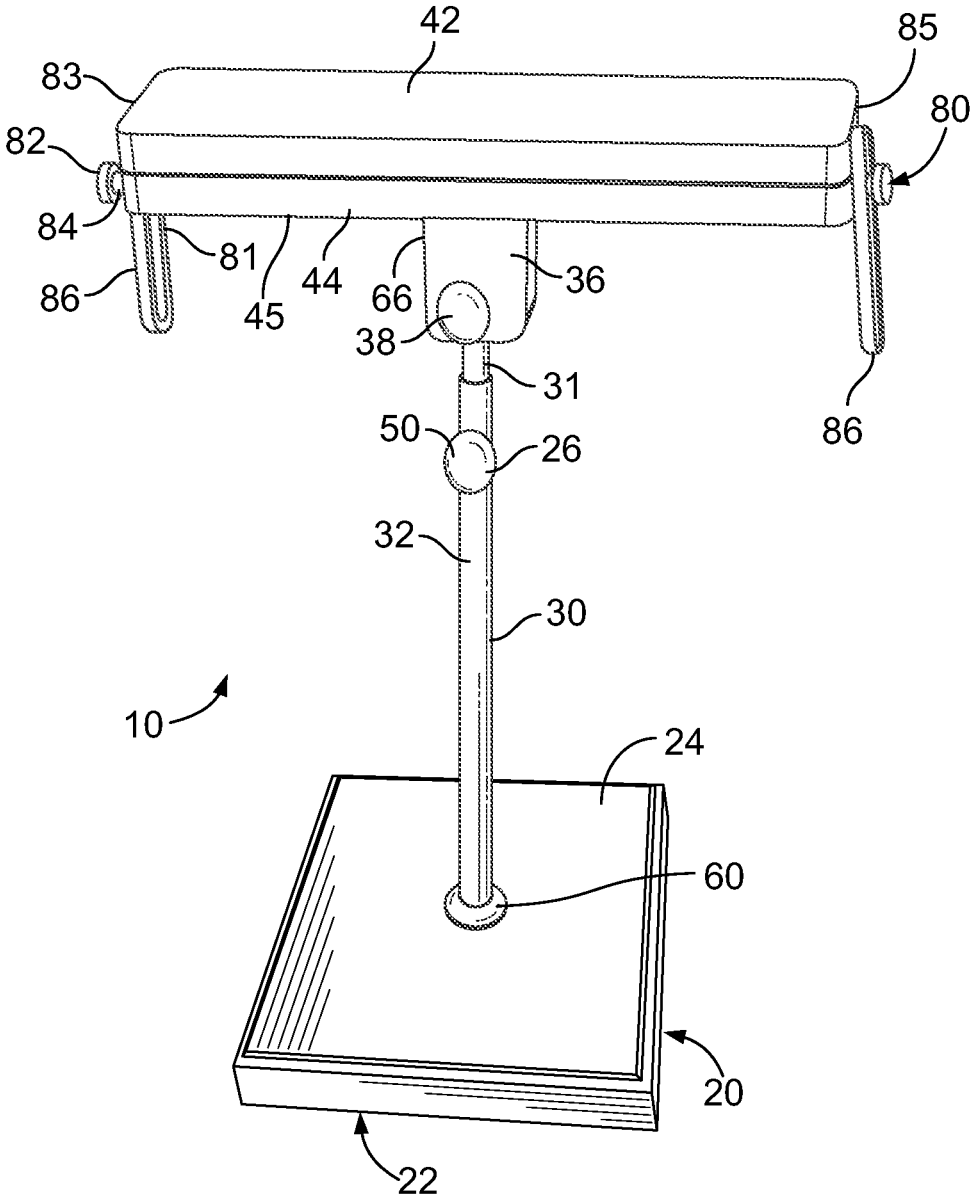
FIG. 1 illustrates a perspective view of one embodiment of the device according to the present invention.

FIG. 1 shows a device 10 for assisting a hair stylist in performing his or her hair styling functions in accordance with the present invention. The inventive hair stylist device 10 includes a floor base 20, an optional telescopically adjustable support pole 30 and two boards, top board 42 and bottom board 44, for holding strands of hair between them, as will be explained. In discussing the orientation and relative dispositions of the parts herein will assume to have the device 10, and other alternative devices, in the working position, that is, the base 20 is on the floor, or the boards are mounted on an external support (not shown in FIG. 1). In the following description, identical or like parts or elements shall be indentified by the same numeral, and similar but slightly different parts will be identified by a prefix and than the same numeral.

The base 20 has a lower surface 22 (not visible in FIG. 1) disposed closest to the floor and an upper support surface 24 which is connected to support pole 30 by use of a screw threaded attachment, of which handle 26 is shown, or by any other conventional means. Pole 30 is optionally adjustable in height. The base 20 may be transportable by including wheels, casters or other means for movement of the base 20, as will be discussed below with reference to the embodiment FIG. 2.

Figure 2:
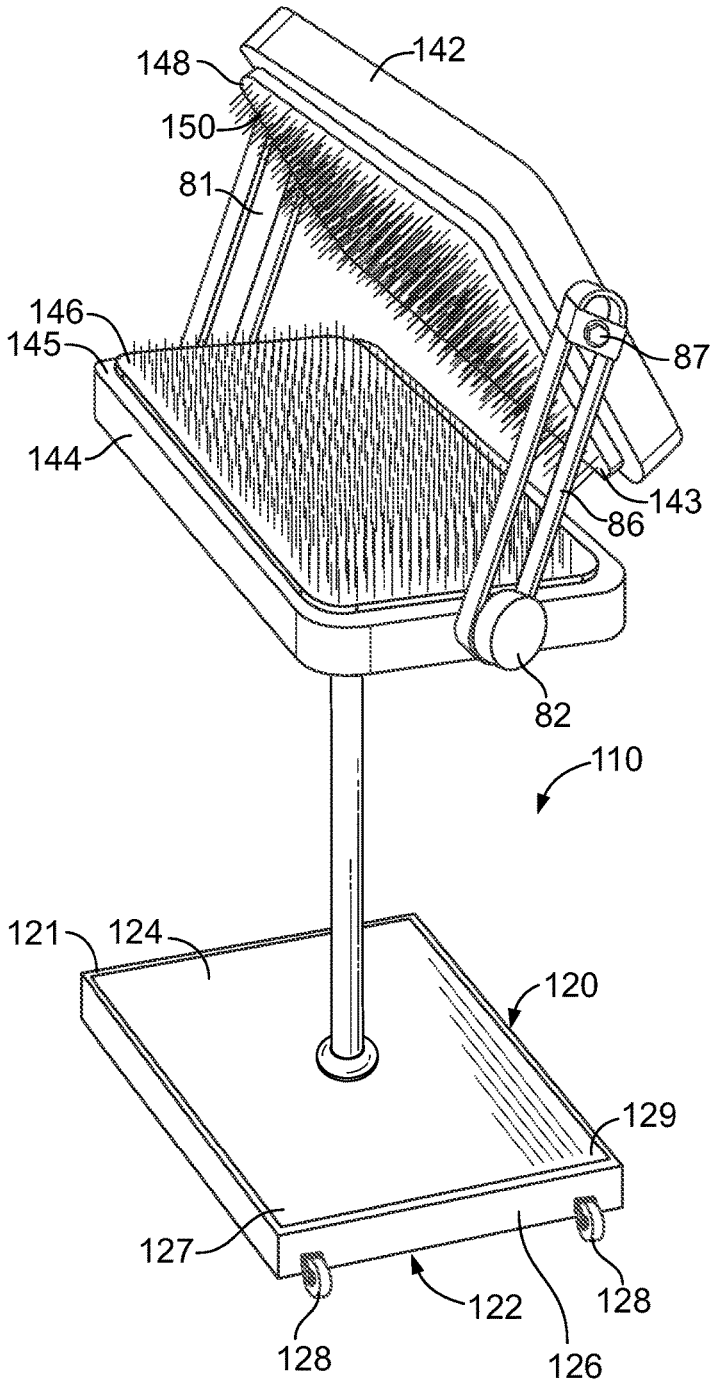
FIG. 2 is a perspective view of another embodiment of the device similar to the embodiment of FIG. 1, with the device being held in an open position.

Support pole 30 may be formed from a single element having a fixed length as shown in FIG. 2, thereby providing a fixed height to the top end thereof. However, and preferably, support pole 30 comprises a smaller diameter rod 31 and a lower hollow section 32 (FIG. 1), which is slidably attached to the base 20. The smaller diameter rod 31 ideally has a telescoping relationship with the tubular hollow section 32 and these together allow the support pole 30 to be adjustable in height, similar to the telescoping adjustment for a floor microphone (not shown). The support pole lower hollow section 32 can be in the shape of a tubular retainer 32 having an internal diameter greater than the external diameter of the upper section rod 31. This allows the upper section 32 to slide freely within the tubular retainer lower section 31. Different fastening devices may be used to retain the upper section 32 at the desired vertical position so as to provide a suitable working height. In the preferred embodiment, the height is adjusted using a twist locking cam 50 having a handle 26 to lock together the upper and lower sections 31, 32 at a desired height relative to each other. Additional tubular sections (not shown) may be used with each section having its own locking cam 50 to provide a required height.

The base upper support surface 24 is attached to the lower hollow section 32 by hollow sleeve 60, which slides over, or alternately into, the lower hollow section 32 of the pole 30. The sleeve 60 is attached to the upper support surface 24 by screws or other appropriate attachment and provides a solid support at to retain the pole 30 in place at perpendicular relative to the base surface 24.

The top end of the telescoping rod 31 provides a platform for the hair styling portion of the device 10, that is, the portion that retains and organizes the tufts or strands of hair to enable the user to use as needed. This comprises the two boards 42, 44 with the bottom board 44 has an outer surface 45 that provides an attachment point of a second support element 66 to mount the bottom board 44 to the top end of the rod 31. The connection is through a screws or other appropriate connection to the lower surface 45 of the bottom board 44, which retains the board 44 in both vertical position and orientation relative to the pole 30. During use, the height of the bottom board 44 relative to the floor or relative to the customer who is having hair applied may be adjusted by changing the height of the pole 30 by means of telescoping sections 31, 32 and the locking cam 50.

As seen most clearly in the FIG. 1 embodiment, the device 10 includes a second support element 66, comprising a specialized connection mounting base 36 that provides an aperture (not shown) into which the top end of the rod 31 may be inserted. As can be a seen, a screw connection, of which a handle 38 is seen, can retain the second support element 66 on the rod 31 by selectively engaging the rod 31 by screwing it until it provides a compression engagement onto the rod 31. If needed to move the two boards 42, 44 externally of the combination of the base 20 and pole 30, the handle 38 is rotated to disengage second support element 66 from the rod 31, making the assembly of the boards 42, 44 and second support element 66 combination capable of being connected onto another mounting base 230 that has a rod 231 (FIG. 9) with a diameter comparable to that of rod 31 (FIG. 1). For example, such a secondary rod 231 may be connected as part of a base mounted on a wall (not shown) or on the upper surface 282 of a nearby counter 280 as is in shown in FIG. 9. One significant feature and distinct advantage of the present invention is the capability to provide the mobility of the operational segment of the inventive device, that is, boards 42, 44, without detracting from its functions, capability and effectiveness.

The table mounting base 36 allows the hairstylist to mount the operational portion of the hair styling device 10 (or indeed any of the embodiments of the devices described below) onto a table, a counter top surface 282 (FIG. 9) or the back of a chair by sliding second support element 66 over the rod 231 that is attached to the table, counter top 282 or chair and turning the tightening screw handle 38 to retain the hair styling 10 in place. Screws 224 may be used to attach the base 266 with rod 231 onto the table or countertop surface 282. While the tightening screw from handle 38 is one preferred embodiment for attaching the second support element 66 to the table mounting base 266 of the present invention, several other commonly known alternatives may be used, for example, glue, hook and loop fasteners, clamps or clasps, etc.

FIG. 2 shows an alternative embodiment of the hair styling device 110 to the device 10 shown in FIG. 1. While the boards 42, 44 may be identical to those elements in FIG. 1, the pole may be predetermined length and not adjustable. More significantly, base 120 has an upper support surface 124 two wheels 128 disposed adjacent the two corners 127, 129 on opposed ends of one edge 126 of the lower surface 122. The wheels 128 are disposed closest to the surface 122 adjacent the floor of base 120.

The wheels 128 or casters (not shown) enable the hairstylist to move the hair styling device 110 easily to the location where the stylist needs it for a particular hair styling application. However, the two wheels 128 are disposed only on one side of the base 120 and only make contact with the floor when base 120 is tilted. Thus, base 120 is stable when it is not tilted and is only moveable once the hairstylist lifts the edge 121 opposite the wheels 128 off the floor and rolls the base 120 by the two wheels 122 over the floor. If the base 120 is resting on the floor, the frictional force of the lower surface 122 and the clearance of the wheels will prevent the hair styling device 110 from moving uncontrollably unless the hairstylist first tilts the pole 130 and applies external force to move the base 120 in a desired direction.

Referring now generally to FIGS. 1 through 4, where the boards 42 and 44 are essentially identical between the separate embodiments, top and bottom boards 42, 44 are mounted at an upper end of the post 30. Each of the boards 42, 44 includes a generally planar pad 46, each pad 46 having an attachment surface 47 and a working surface 49. The attachment surface 47 of each of pads 46 is attached by staples, glue, nails or other appropriate means, to inner surface 45 of the bottom board 44 and to an inner surface 43 of the top board 42.

Figure 6:
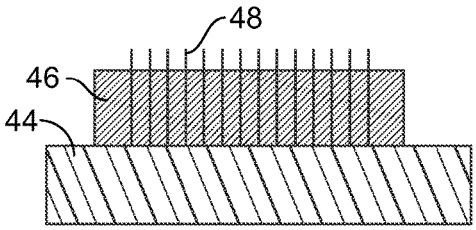
FIG. 6 is a cross-section view of FIG. 5 taken approximately along the line 6-6 showing straight bristles embedded in the pad that is attached to the board.
Figure 7:
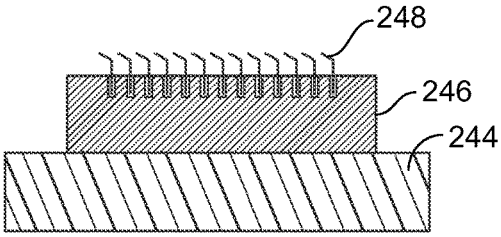
FIG. 7 is a cross-section view of FIG. 5 taken approximately along the line 7-7 showing an alternative embodiment of the pad with bent bristles.

Each of the generally planar pads 46 have a plurality of individual embedded bristles 48 extending from the pad working surface 49 in a direction generally perpendicular to the planar surface working surface 49. The bristles 48 preferably are densely packed and either extend throughout the planar pad 46 as shown in FIG. 6 or alternatively are embedded in the surface so that they are rigidly contained therein as shown in FIG. 7. The bristles 48 can be straight as shown in the cross-sectional view of FIG. 6, or can be bent bristles 148 as shown in the alternative cross-sectional view of FIG. 7. The bent bristles 148 may be utilized to provide a more frictional hold on the hair strands as they are pulled through the hair styling device and thereby result in better retention of the hair strands during working thereof.

The embodiment shown in FIG. 2 includes similar bristles 148 on two opposed pads 146 attached to boards 142, 144 respectively. However, and as can be seen in the perspective view of FIG. 2, some of the bristles 150 differ in length from the bristles 148 to provide a more varied landscape for holding the artificial hair in place.

Referring again to the embodiment of the device 10 shown in FIG. 1, the bottom board 44 is disposed in an opposed relation with the top board 42, so that when brought together, the oppositely disposed surfaces 43, 45 of the boards 42, 44 have the bristles of one board extend toward the opposite surface of the other board. When brought into the working position, the bristles are interleaved with the bristles of the opposite board leaving sufficient gaps therebetween to loosely hold the hair strands in place sufficiently securely to allow the hair stylist to comb, disentangle, manipulate and otherwise work the hair tufts or strands (FIG. 4) while also permitting the stylist to withdraw specified ones of the strands or tufts when needed to apply the hair strands to the head of a customer.

Figure 3:
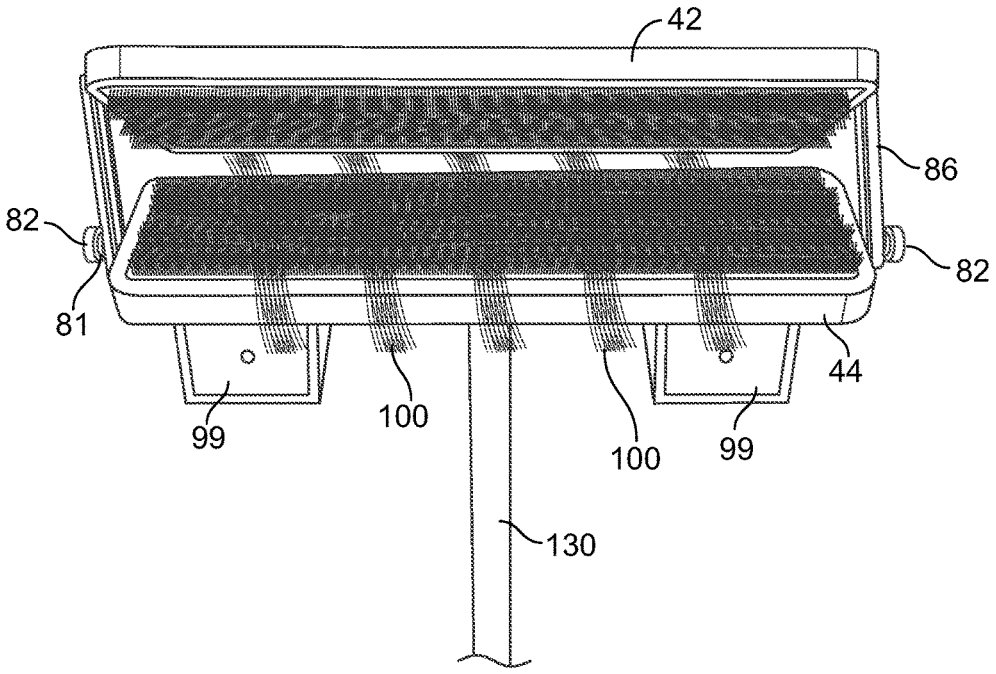
FIG. 3 is a perspective front view of the embodiment of the device as shown in FIGS. 1 and 2) that further illustrates artificial hair laid on top of the bristles.

It is generally required that the boards 42, 44 be completely separated when in the open position, as shown in FIG. 3, so that the hairstylist may lay out the strands of hair across the transverse dimension of the bottom board 42 and the hair will thus drape over both sides of the device 10. This assists in the styling of the artificial hair, and especially in the combing out and disentangling of the hair since both sides of the device are accessible, and the all ends of the hair strands may be worked on without having to remove and reposition the hair in the device during this process. As will be discussed below with reference to FIGS. 8-11, a more elongated device embodiment may provide even more efficiency in exposing most of the lengths of the hair to the stylist when the device is in the closed position.

The boards 42, 44 can be locked in place by a locking mechanism 80 holding the respective inner surfaces opposite to each other when brought together in the working position. The locking mechanism 80 is disposed adjacent the inner surfaces on longitudinal sides 83, 85 of each of the boards 42, 44. The locking mechanism 80 may comprise a flattened or planar oval shaped loop 86, or a slotted rectangular strip connected to one board, for example, top board 42, by a nut 87 or other threaded fastener as shown in FIG. 2, which middle portion includes a slot 81 which is engaged by the cam 82 by straddling pin 84 disposed on the other board, for example, bottom board 44.

Figure 4:
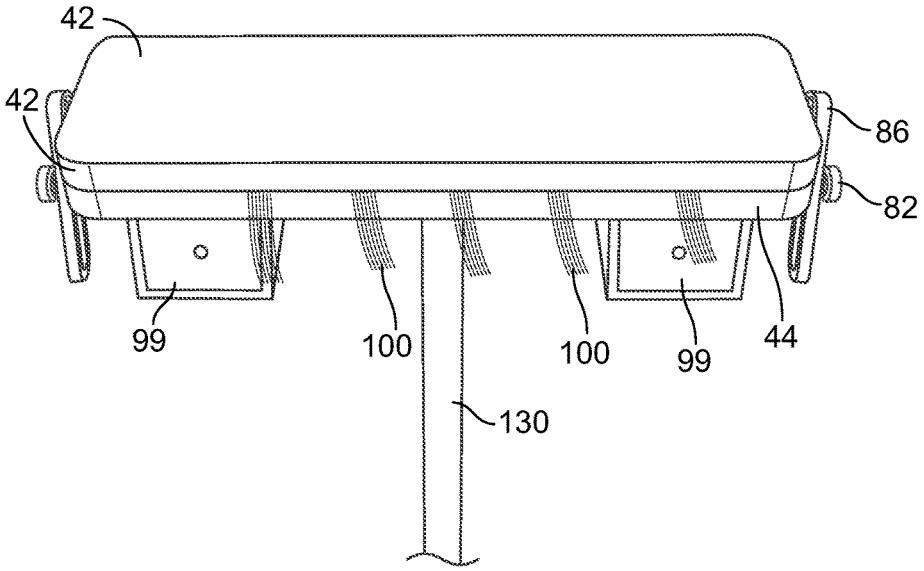
FIG. 4 illustrates a perspective front view of the embodiment of FIG. 3, but in a closed position.

A locking cam 82 having internal threads can be threaded onto the pin 84, which itself may be threaded to receive the locking cam 82, and when tightened, cam 82 securely retains the position of the pin 84 relative to the loop 86, and thus of the two boards 42, 44, in a fixed relation. The locking cam 82 holds two boards 42, 44 in place at a desired relative position whether they are in open or closed positions, when the cam 82 is tightened. FIGS. 2 and 3 show the top and bottom boards 42, 44 in an open position and the cam 84 holding them fixed, while FIGS. 1 and 4 show the boards 42, 44 in closed position and the cam 84 holding them connected to one another in a closed and opposed relation. As is best illustrated in FIG. 3, the hairstylist will open one to several packages of commercial or artificial hair 100 and place them vertically on the bristles pads 46 of the bottom board 44, and close the boards 44 as in FIG. 4 to enable the stylist to work on the hair strands conveniently and efficiently.

Referring now to FIG. 2, but also as well to the other embodiments, the pads 146 are attached to the inner surfaces 143, 145 of boards 142, 144 all the while ensuring that the pads 146 are positioned so that the bristles 148, 150 do not come into contact with each other and thus do not interfere with the closing of the boards 142, 144 in when the inner surfaces 143, 145 are brought together in the closed position shown in FIGS. 1 and 4. The size of the bristles 418 on each pad 146 may vary depending on the different types of hair that are being applied. For example, for straight hair, the gaps between the teeth may be smaller and longer bristles 148 may be used as shown in FIG. 2 than those devices intended for hair that is more curly or frizzy.

The embodiment of the device shown in FIGS. 3 and 4 includes two drawers 99 for storing tools, materials and other necessities for the hair braiding, cleaning, interweaving and applying the hair strands to the customer's scalp. The drawers 99 can be attached by conventional means to the underside or outer surface of the bottom board 44. It is preferable to have the fronts of the drawers 99 inset or set back to some degree to provide a more convenient working space under the device.

Figure 5:
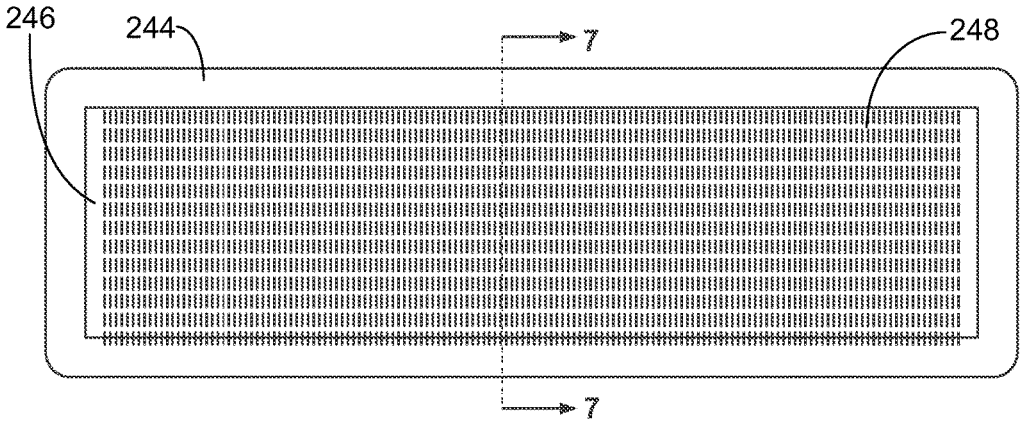
FIG. 5 is a top view of one side of the board of the embodiment showing uniform bristles.

Referring now to FIG. 5, a top plan view of a bottom board 44 is shown with the bristles 48 being in a bent configuration as in the cross-sectional view of FIG. 7. It should be noted that the pad 246 does not necessarily reach to the edges of the boards 142, 144, although this may be desirable if space is a consideration in the working environment of the device. Because the bristles 248 are shown in the bent form in FIG. 5, the cross-section taken along line 7-7 shows the bristles 148 partially embedded in the elastomeric material of the pad 246 attached to the bottom board 244.

Referring now to FIG. 6, the bottom board 44 is shown in cross-section having straight bristles 48 that extend al the way through the pad material from one surface to the other. To provide a more efficient manufacturing procedure, a wire staple having two ends can be inserted through the material of pad 46 to provide two bristles 48 for each staple, as shown.

Figure 8:
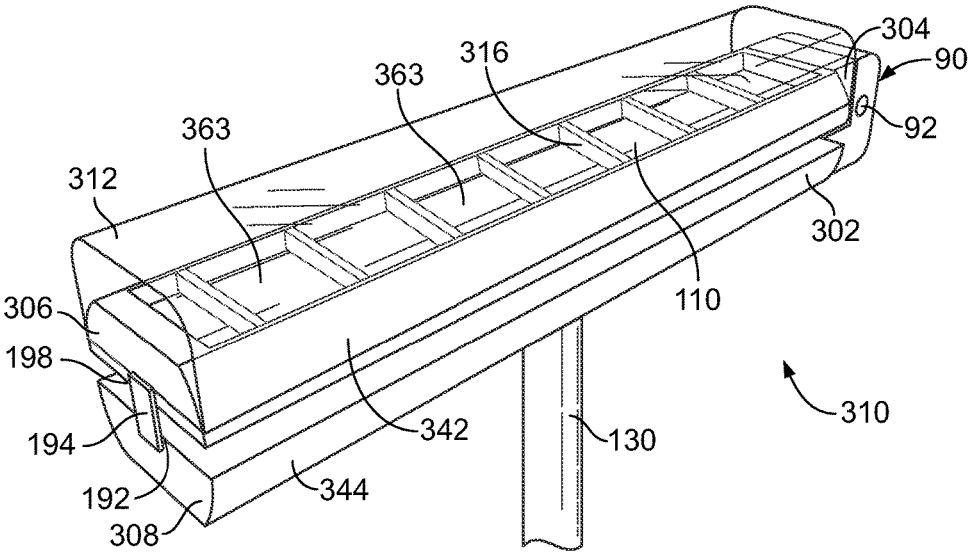
FIG. 8 is a perspective view of another alternative embodiment showing compartments along an upper surface of the top board.
Figure 9:
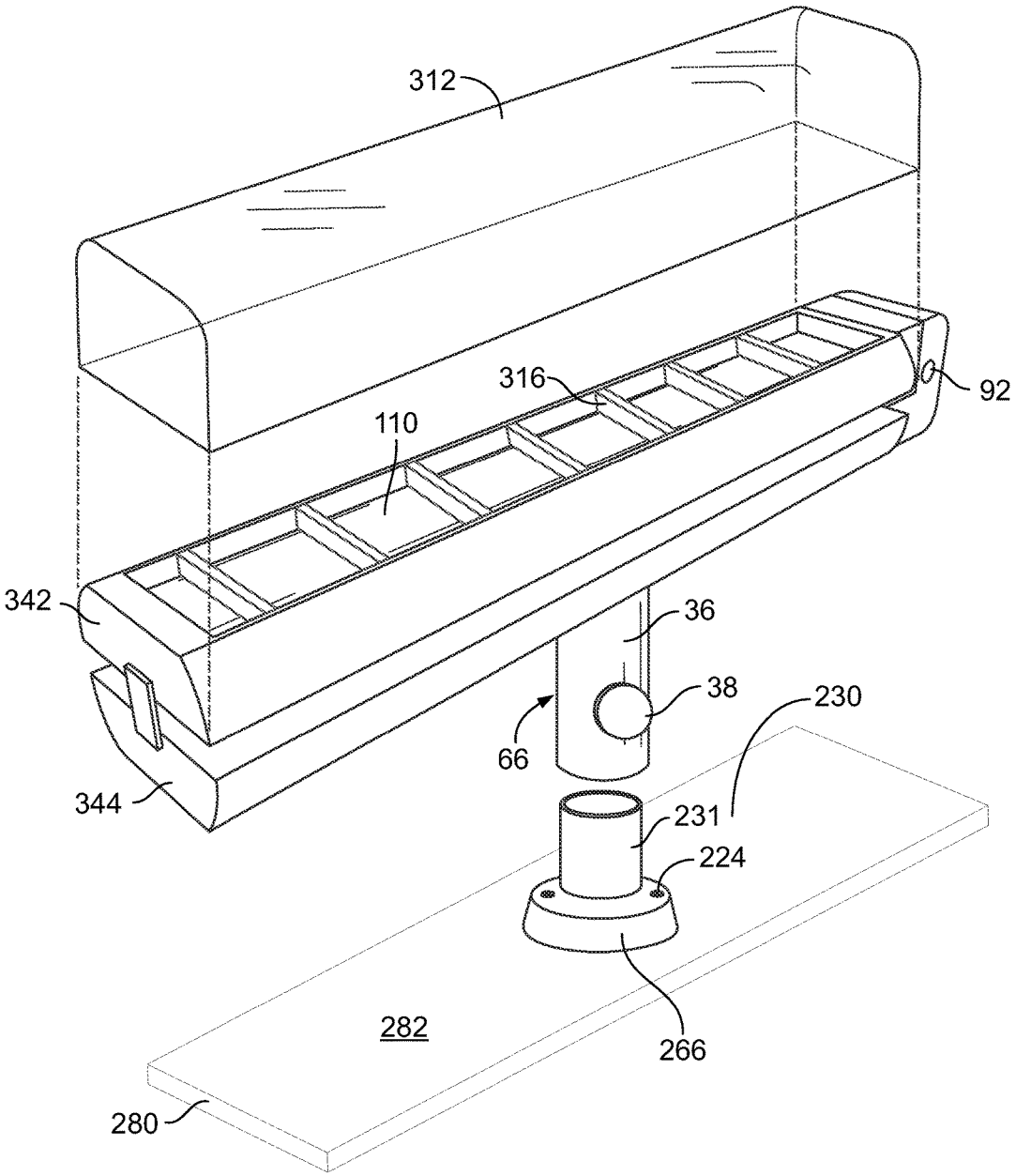
FIG. 9 is a perspective and partially exploded view of the embodiment shown in FIG. 8.

Referring now to FIGS. 8 and 9, therein is illustrated an alternate embodiment of the hair styling device 310 in which the boards 342 and 344 are somewhat elongated relative to the embodiments 10, 110, 210 shown in FIGS. 1-7. Moreover, the boards 342, 344, do not open in the same way as the other embodiments, but have a different type of opening and closing mechanism. The boards 342, 344 are connected to each other at a respective longitudinal ends 302, 304 by a hinge 90, and are disengageably connected to each other at their opposite end 306, 308 by a locking mechanism 198, when in the closed position.

Figure 10:
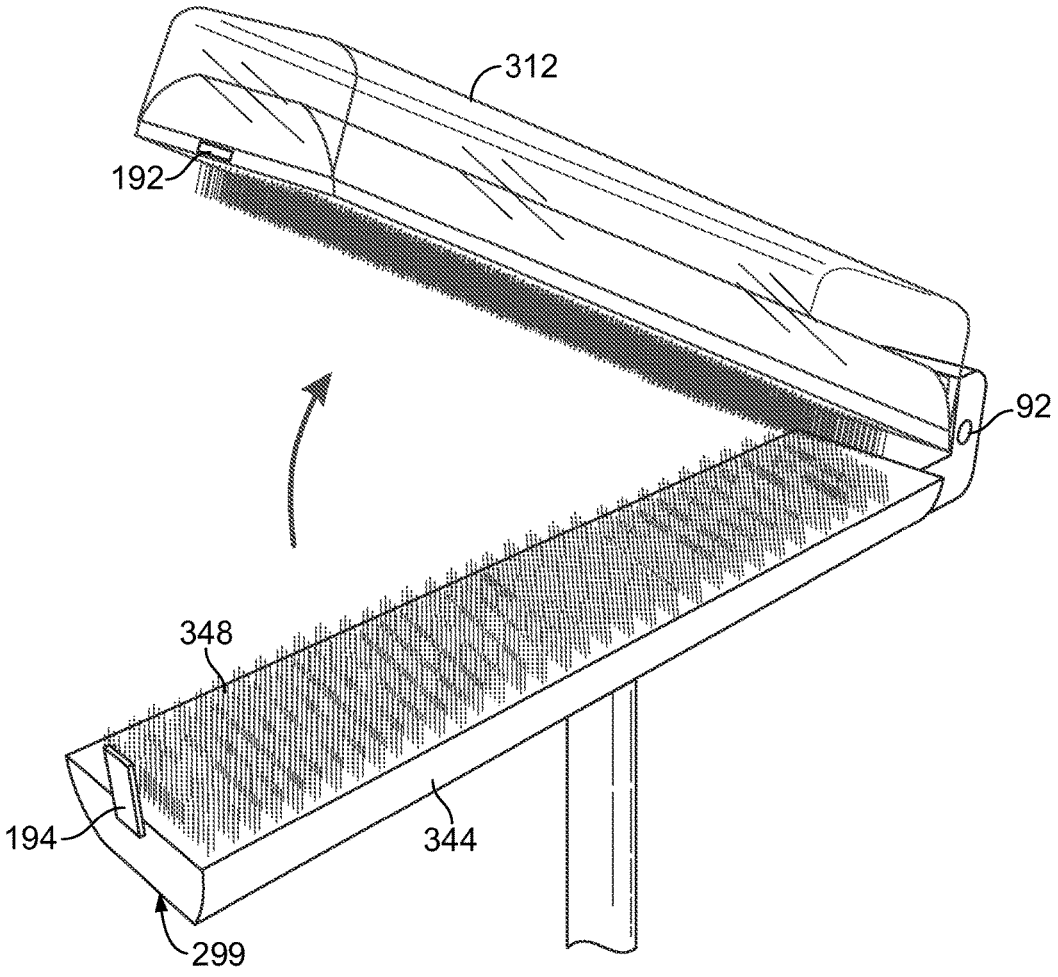
FIG. 10 is a perspective view of the embodiment of FIG. 9, showing the device in an open position with the cap over the receptacles.

A first pair of hinge tabs extended from the top board 342 interlock with a second pair of hinge tabs extended from the bottom board 344. A pin 92 is inserted through apertures provided in each of the hinge tabs to pivotally join the two boards 42, 44 together. This hinge mechanism 90 is illustrated in FIGS. 8-10, where in FIG. 10 it is in the open position. The hinge mechanism 90 allows the boards to be opened by first disengaging the locking mechanism 194 and then by lifting up the top board 342 end 306 opposite from the hinge 90 by pivoting around the hinge 90.

When two boards 342, 344 are in closed position, a locking mechanism 198 is used to close securely the two boards 342, 344. The locking mechanism 98 may be a long rectangular shaped tab 194 connected to end 306 which engages a protruding clasp 192 in the bottom board end 308. Alternatively, a locking latch may be inserted into a catch depression. In the embodiment shown in FIG. 8, the locking latch 194 on the top board 342 engages and hooks up with the protruding clasp on the bottom board 344 securely to hold the boards together. The locking latch 194 holds two boards 342, 344 in place when they are in a closed position. The hinge 90 may include stop positions to hold the board 342 in specified predetermined open positions as shown by the arrow in FIG. 10 to permit the hairstylist to insert the hair strands in place between the bristles 348.

FIG. 10 illustrates an alternative embodiment in its open position. The embodiment of FIG. 10 also illustrates another aspect of the invention, that is, the lack of a mounting or support structure for supporting the operating portion of the invention, for example, on a pole 130. The way to utilize this embodiment is to have a means to attach the underside surface 299 of the bottom board, such as hook and loop fasteners, glue, or a locking receptacle to enable the bottom board to be held securely on a table, shelf, countertop or other ready surface, such as countertop 282 shown in FIG. 9. If it is desired to make the operating portion of the invention portable, than the temporary but secure retention of that portion on a surface is necessary, and can be engineered into the device.

The hair styling device is a versatile device that may also provide additional functions, such as the storing accessories that are necessary for the braiding process, which storage facilities may be attached either to the top or bottom boards. FIGS. 3 and 4 shows the hair styling device 110 including two drawers 90 attached to the bottom board 44 at a bottom surface thereof.

The embodiments of the device shown in FIGS. 8-10 illustrate an alternate placement of the storage positions on the top board 342 of the hair styling device 310 with the base or top surface 343 of the top board 342 including various types of storage mechanisms. The separated compartments 363 are disposed on the top surface of the top board 342 as shown in FIGS. 8-11. These separate storage compartments 363 may be separated by vertical dividers 316. An optional protectable plastic cover 312 may be utilized to protect the compartments 363 from contamination. The plastic cover 312 is used to maintain accessories stored in the compartment 363 in a sanitized fashion and prevent them from falling on to the floor when the top board 342 is pivotally lifted to the open position.

Figure 11:
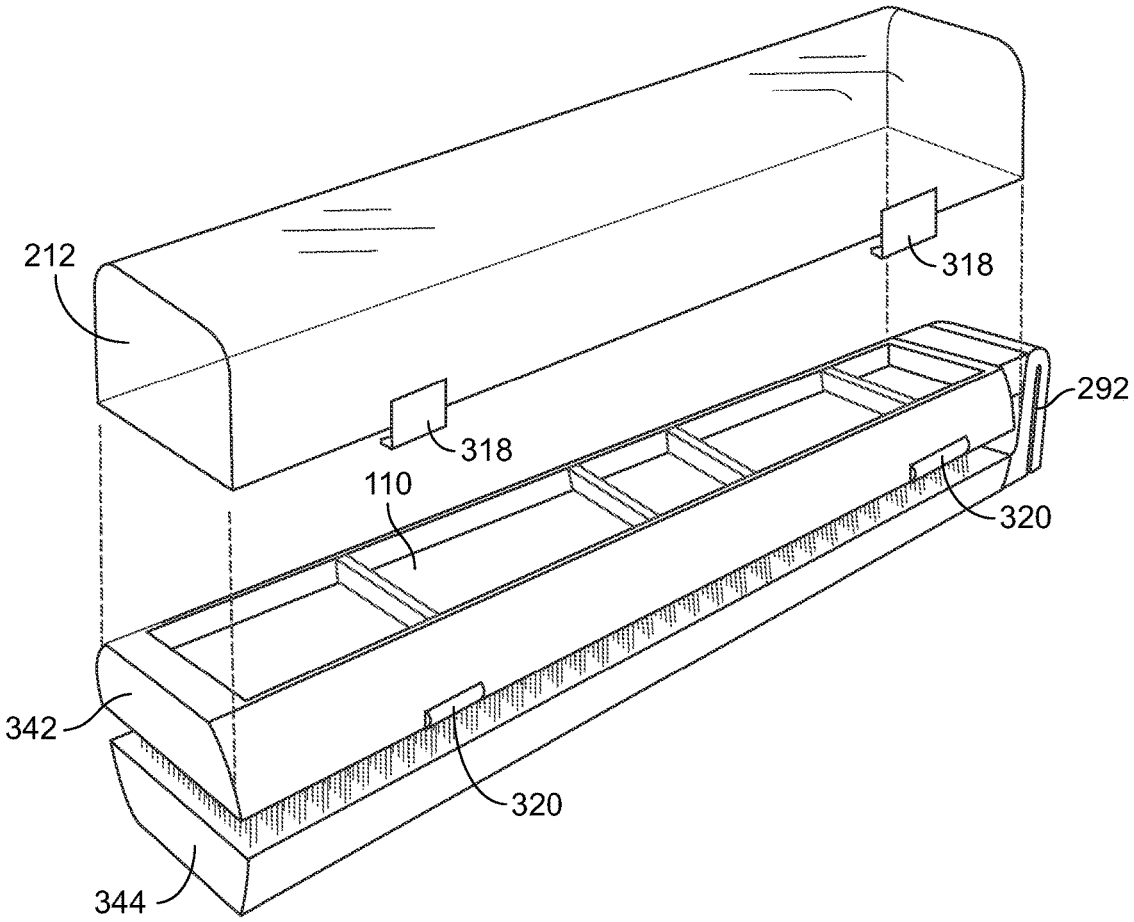
FIG. 11 is perspective and partially exploded view of an alternative embodiment of the device according to the present invention.

An alternate connection mechanism for the clear plastic cover 212 is shown in the embodiment of the partially exploded view of FIG. 11. Swivelable connecting hinges 318 connect to hinge connectors 320 disposed on the side surface of the top board 342. The cover 212 can be tilted back to provide access to the storage compartments 363 in the top of board 342, and can be closed up again after the desired item is taken out. Also, a different type of hinge 292 for opening and closing the boards 342, 344 is shown and will be explained below.

In alternative embodiments of the inventive hair styling device 410 shown in FIGS. 12-17, different inventive features are described and illustrated. However, for all of these embodiments shown therein each provides for a unitary bottom board 442 and top board 444, mad of a flexible material, such as plastic or a hard elastomeric material. Similarly to those of the embodiments described in reference to FIGS. 1-11, the boards include the bristles or pins extending inwardly from inner surfaces of the boards, and toward the other board surface. The pins also are separated when the two boards are brought together to engage each other, so that gaps remain between the pins. Hair strands, such as those shown in FIGS. 3-4, are inserted into the boards between the pins before closing the boards to their engaged position, to permit the hair strands to be loosely but securely held within the device.

The unitary nature of the boards of FIGS. 12-17 provide a number of benefits, including that the manufacturing process may be simplified. For example, these parts may be made by and injection molding process, and result in much lighter and more portable devices 510, 610 respectively. For the embodiments shown in FIGS. 16 and 17, although not completely unitary, have interchangeable plastic pads 746, 846 that are also capable of being made by injection molding, as will be described.

Figure 12:
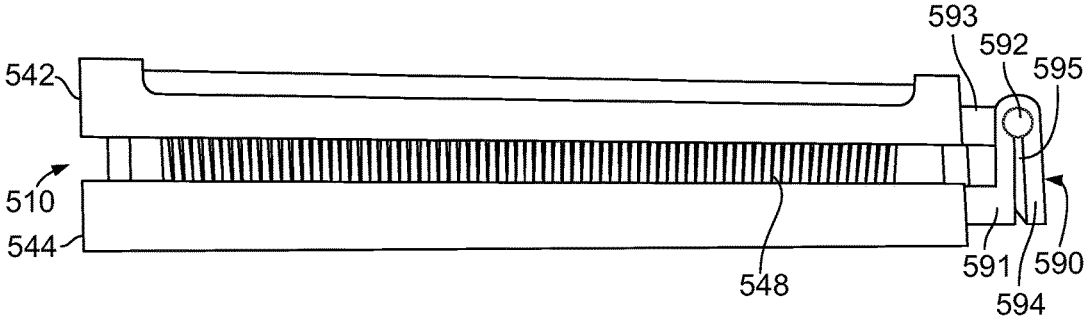
FIG. 12 is an elevational view of still another alternative embodiment of the device in the closed position according to the present invention.
Figure 13:
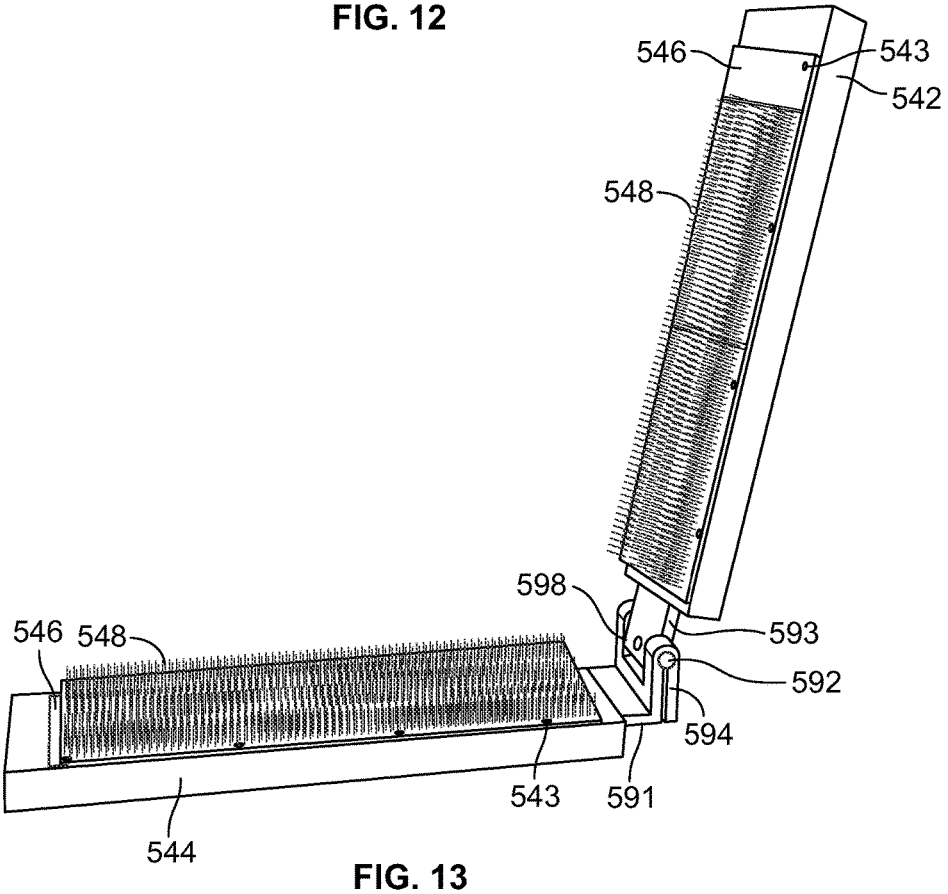
FIG. 13 is a perspective view of the embodiment of FIG. 12, showing the device in an open position.
Figure 14:
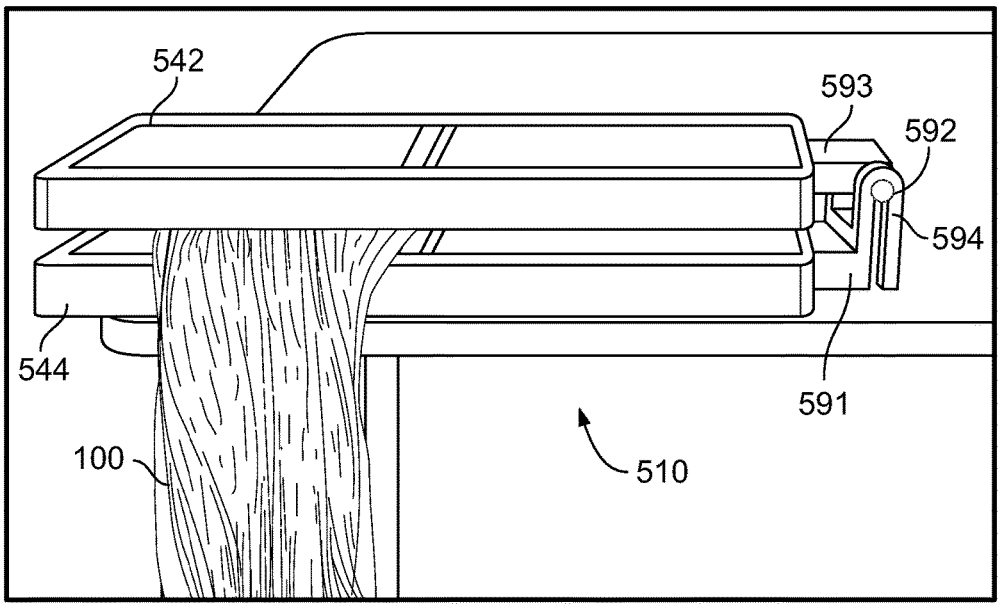
FIG. 14 is a perspective view of the embodiment of FIG. 12, showing the device in a closed position showing the retention of the artificial hair.

Referring now to the embodiment of the device 510 shown in FIGS. 12-14, the boards 542, 544 include the bristles or pins 548 extending inwardly from inner surfaces of the boards 542, 544, respectively. These pins 548 also are separated when the two boards 542, 544 are brought together to engage each other, so that gaps are left between the pins 548. Bulk hair 100, shown in FIG. 14, 542, 544, or hair tufts or strands, are inserted into the boards between pins 548 before closing the boards 542, 544 to their engaged position, to permit the hair strands to be loosely but securely held within the device 510.

For the most part, the boards 542, 544 have similar structures to those of the hair styling devices 10, 110, 210, etc., shown in FIGS. 1-11, but one major exception is the connection hinge 590 of the boards 542, 544 to each other. Hinge 590 is also a unitary construction with the rest of the boards 542, 544, and part of hinge 590 is disposed on one board and part on the other board. Tab 593 extends from one end of the board 542 and includes a laterally extending pin 592 extending transversely to the longitudinal dimension of the board 542. A corresponding tab 591 extends from the end of board 544 and loops around to provide a U-shaped channel 595 for holding the pin 592 at an upper end of the U-shape. An aperture at the upper end of the U-shaped channel 595 is dimensioned to retain the ends of the laterally extending pin 592 within the aperture and engaging the channel, but the engagement is not so tight as to impede the ability of board 542 to rotate relative to board 544 around the hinge 590. The pins 592 are preferably of the type that allows them to be snap fit into the U-shaped channel 595.

While the unitary nature of the embodiment shown in FIG. 12 is evident, and alternative method of manufacture is to make the boards 542, 544 without pins. Pins 548 can be injection molded into a pad 546 that can be attached tot the inner surfaces of boards 542, 544 by an appropriate manes, such as screws 543, as shown, or glued to the surfaces. In use, the boards 542, 544 are brought together as described above and shown in FIG. 14, around a mass of bulk hair 100 that can then be combed, detangled, separated and combined to produce the desired effect when applied to a customer's natural hair, as explained above.

Figure 15:
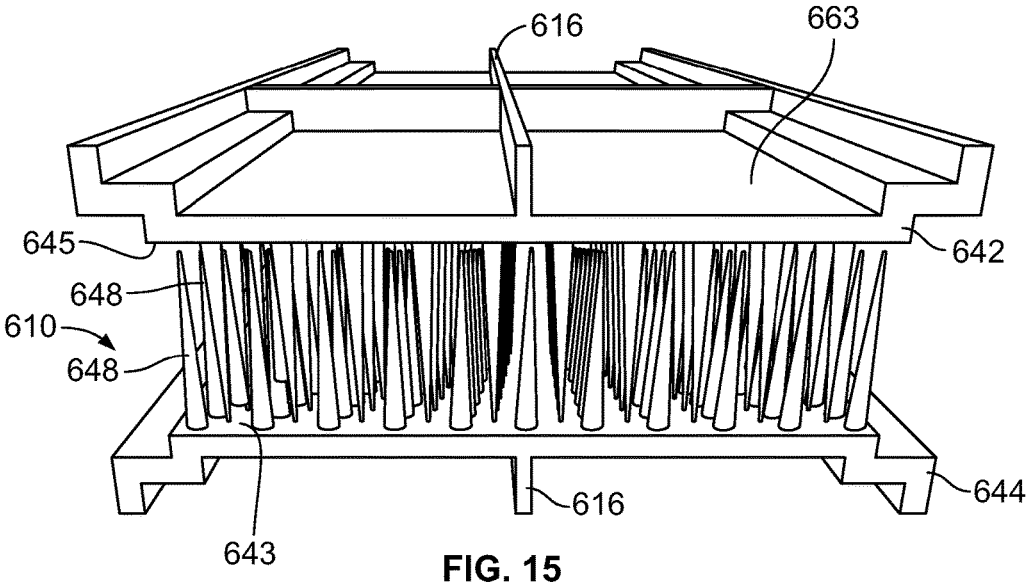
FIG. 15 is a perspective end view of yet another alternative embodiment of the device in the closed position according to the present invention.

Viewing the embodiment of device 610 shown in FIG. 15, it will be appreciated in view of the injection molding manufacturing process used, that the pins 648 may need to be somewhat larger than the pins or bristles of the embodiments of FIGS. 1-11. The longer and larger diameter bristles 648 allow the device 610 to have more depth, that is, more space between the inner surfaces 643, 645 of the boards 642, 644, so that the hairstylist may work with larger bulk quantities of artificial hair during the hair application process. Staggered bristles 648 on both top and bottom boards 642, 644 permit the loose holding of the hair strands 100 in place while simultaneously permitting their withdrawal when needed. Also, wider spacing between teeth allows an easier tug and release for the exact amount of hair the hairstylist would like to use at one time. As shown, receptacle compartments 663 separated by vertical dividers 616 can be included in the injection molded top and bottom boards 642, 644, which as shown can be interchangeable with each other. That is, flipping the device 610 is possible so that top board 642 reverse position with bottom board 644.

Figure 16:
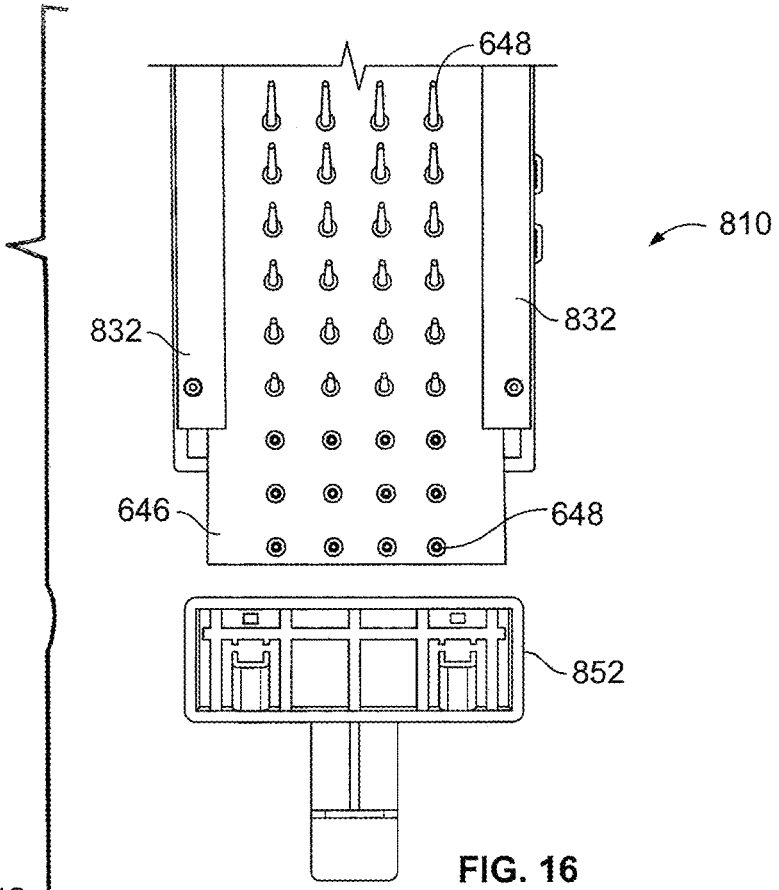
FIG. 16 is a partially exploded top plan view of the alternative embodiment of the device shown in FIG. 15.

Referring now to the partially exploded view of device 810 in FIG. 16, the removable pad 646, having large sized bristles 648, can be inserted in a direction parallel to the inner surface of the board and into a slot formed by the two cantilevered retention members 832 and once fully inserted, can be fixed in place by connecting the end connection 852 to the end of the board.

Figure 17:
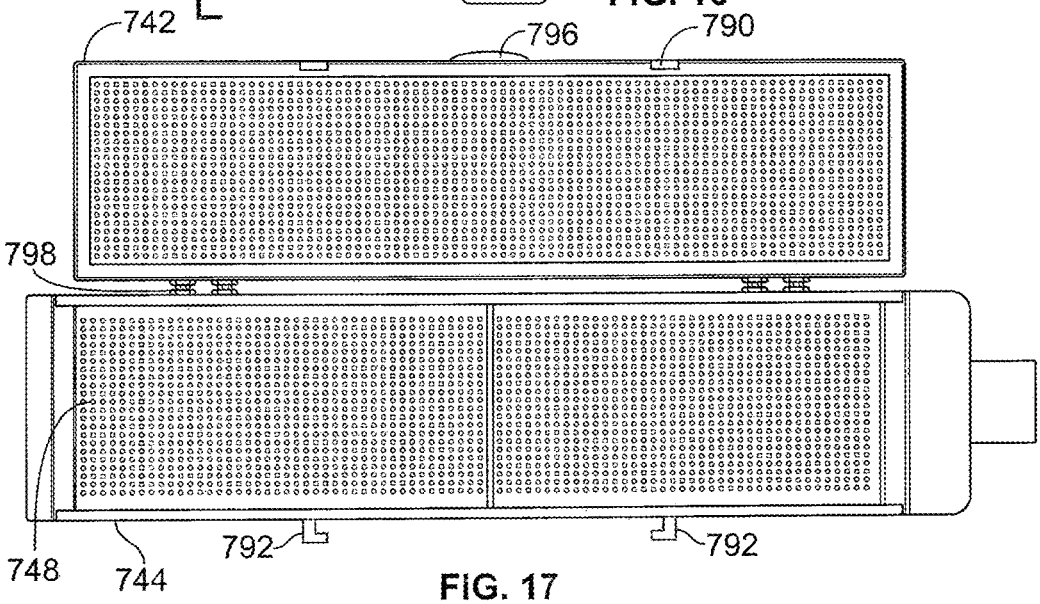
FIG. 17 is a top plan view of another embodiment of the device showing an alternative hinge configuration.

Referring now to the device 710 shown in FIG. 17, a different hinge mechanism is shown that includes hinges 798. While the intent of the prior embodiments is to have the transverse direction completely free and open, this embodiment includes hinges 798 along the longitudinal edges of the two boards 742, 744. Thus, the boards rotate along a longitudinal axis, rather than a lateral one as in the other embodiments. This device 710 may be usable for when the customer requires shorter hair strands. Also, when the hair strands need to have extensive work on them and must remain in place within the device, it may be possible to drape the hair strands in the longitudinal direction in between the staggered bristles 748 of the device 710.

To enable to lock the boards 742, 744 when the hair stands are draped in the device 710, two latches 792 are disposed on the other longitudinally extending edge of the board 744, located opposite the edge of hinges 798. The latches 792 can engage two corresponding clasps or apertures 790 on the corresponding edge of board 742. To assist in opening and closing the top board 742, a handle 796 centrally located between the two clasps 790 allow the user to manipulate the device 710 more easily.

It will be readily apparent that the embodiments shown in FIGS. 12-17 are lighter and more maneuverable than the devices of FIGS. 1-11. That is, because of their plastic material, the devices 510, 610, 710, and 810 can be moved much more readily from one to another area where they are needed. Thus, multiple such devices can retain the hair necessary for different types of applications to retain hair accessories that are needed and can be stored in a secure and clean area for use when needed. Thus, filling the devices with the appropriate hair strands necessary for a standard application can be avoided from one customer to another, while the inexpensive manufacturing of the devices can enable the hairstylist to have several preloaded devices ready for sequential customers' customized hair applications.

Additional features of the device may be added by those skilled in the art of the invention, thus the invention should not be limited by the embodiments shown in the drawings. It is to be appreciated that alternative embodiments of the generalized embodiment might include other modifications or alterations without departing from the spirit and scope of the present invention. For example, the size, shape, orientation and/or materials of the various components may be changed to achieve different effects without departing from the spirit and scope of the invention. Thus, the scope of the invention should not be limited by the specific structures disclosed but instead the true scope of the invention should be limited only by the following claims.

What is claimed is:

1. A hair styling device for holding and organizing strands of commercial or artificial hair as it is used in braiding, weaving and similar hair applications, comprising:

a base;

an upright stand pole extending from said base including a height adjustability mechanism to allow the stand to be maintained at variable heights;

a removable hair retention assembly comprising a bottom board and a top board, including a mounting member, the mounting member being attachable to a plurality of external mounts and providing for different connections of the removable hair retention assembly to different mount bases associated with said external mounts, the removable hair retention assembly being interchangeable between the plurality of external mounts;

the bottom board having an inner and outer surface, the bottom board outer surface being connected to said mounting member, and further including a first generally planar pad having an attachment surface and a working surface, the first pad being attached to the bottom board inner surface so that the attachment surface is closest to the bottom board inner surface and a first plurality of embedded bristles extending in a perpendicular direction away from the bottom board inner surface and the working surface of the first pad;

the top board being engageable with said bottom board, the top board having an inner and outer surface containing a second generally planar pad having an attachment surface and a working surface, the second generally planar pad being attached to the top board inner surface so that the attachment surface is closest to the top board inner surface and a second plurality of embedded bristles extending in a perpendicular direction away from the top board inner surface and the working surface of the second pad; and a mechanical fastener for connecting the top board to the bottom board, thereby to maintain the top board working surface in opposed relation to the bottom board working surface causing the bristles from the first plurality of embedded bristles to become engaged with the second plurality of embedded bristles and to remain stationary relative to each other, whereby when the first and second boards are engaged, the bristles on both pads interleave and are continuously separated from each other thereby creating small gaps for insertion of strands of artificial or commercial hair therebetween, the gaps having sufficient dimensions between the interleaved bristles to loosely hold the hair strands in place sufficiently securely as to permit operations on the strands of hair without dislodging the strands from the device.

2. The device of claim 1 wherein the mechanical fastener is provided having a clasp for connecting the top and bottom board to each other at a desired open position allowing for placement of hair over and between the bristles of the bottom board and a closed position wherein the bristles on the first pad of the bottom board interleave with the bristles of the second pad on the top board when the inner surfaces of the boards are opposed to each other whereby the commercial or artificial hair is disposed in gaps between the bristles of said two boards and the engagement of the bristles inhibit motion of the commercial or artificial hair.

3. The device of claim 1 wherein the mechanical fastener further comprises a pivotable hinge connecting the first attachment point of the top board to the second attachment point of the bottom board, the attachment points being at corresponding ends of the longitudinally connected boards.

4. The device of claim 1 wherein at least one drawer is attached to one of the outer surfaces of the boards capable of storing excess bulk hair and hairstyling accessories.

5. The device of claim 4 wherein the top board includes a compartment disposed on an outer surface of the top board for providing a storage space for bulk hair and hairstyling accessories and includes a cover capable of being disposed over the outer surface for covering the at least one compartment.

6. The device of claim 1 wherein the top and bottom boards comprise one or more materials taken from the group consisting of wood, pressed wood, plastic, metal, metal plate covered wood, and combinations thereof.

7. The device of claim 1 wherein bristles are straight at the opposite end from the planar pad.

8. The device of claim 1 wherein bristles are attached at a first end to the planar pad and are bent at an angle at the opposite second end away from the planar pad.

9. The device of claim 1 wherein the bristles comprise a metal.

10. The device of claim 1 wherein the base includes plural wheels for transporting the device and a mechanism for disabling the wheels so that the base is no longer movable.

* * * * *